United States Patent [19]

Fechner et al.

[11] Patent Number: 5,074,836

[45] Date of Patent: Dec. 24, 1991

[54] AUTOMATED STACKER FOR PREVIOUSLY FAN FOLDED FOR CONTINUOUS FEED PRINT MEDIA

[75] Inventors: Joseph F. Fechner, Indialantic; George R. Goodley, II, Palm Bay; William J. Fries, Merritt Island; Dennis A. Loewen, Palm Bay; Neal F. Ridenour, West Melbourne; Vahe H. Malakian, Palm Bay, all of Fla.

[73] Assignee: Storage Technology Corporation, Louisville, Colo.

[21] Appl. No.: 562,116

[22] Filed: Aug. 3, 1990

[51] Int. Cl.[5] ..... B65H 45/101

[52] U.S. Cl. ..... 493/411; 493/29

[58] Field of Search ..... 493/10, 23, 24, 29, 493/411, 413, 414, 448, 451

[56] References Cited

U.S. PATENT DOCUMENTS

| | | | |
|---|---|---|---|
| 4,030,720 | 6/1977 | Jones | 493/12 |
| 4,172,595 | 10/1979 | Müeller et al. | 493/413 |
| 4,213,601 | 7/1980 | Cattorini et al. | 493/412 |
| 4,227,683 | 10/1980 | Spangler et al. | 493/10 |
| 4,358,285 | 11/1982 | Fujino | 493/411 |
| 4,460,350 | 7/1984 | Mittal et al. | 493/412 |
| 4,540,395 | 9/1985 | Bekooy | 493/446 X |
| 4,559,031 | 12/1985 | Gysung et al. | 493/413 X |
| 4,846,454 | 7/1989 | Parkander | 493/412 |

FOREIGN PATENT DOCUMENTS

| | | | |
|---|---|---|---|
| 1436881 | 11/1968 | Fed. Rep. of Germany | 493/411 |
| 0110021 | 8/1979 | Japan | 493/10 |

*Primary Examiner*—William E. Terrell
*Assistant Examiner*—I. Addison Marlott
*Attorney, Agent, or Firm*—Dorr, Carson, Sloan & Peterson

[57] ABSTRACT

The automated print media stacking apparatus makes use of a passive guide in the bottom of the stacking bin to automatically initiate the folding operation on printed continuous feed fan fold print media (e.g. - paper) and to precisely refold and stack the printed media as it is output by the high speed line printer. The automated print media stack apparatus includes a slotted forms refold tray that is located at the bottom of the stacking bin. The slotted refold tray includes a slot located in the center thereof for automatically receiving the leading edge of the first sheet of print media that is output by the high speed line printer. An associated media puller is used to insure the proper positioning of the leading edge of the first sheet of print media into the slot in the paper refold tray.

7 Claims, 4 Drawing Sheets

AUTOMATED STACKER FOR PREVIOUSLY FAN FOLDED FOR CONTINUOUS FEED PRINT MEDIA

FIELD OF THE INVENTION

This invention relates to high speed line printers and, in particular, to a stacker mechanism that automatically feeds, folds and stacks the printed fan folded continuous feed print media that is output by the high speed line printer.

PROBLEM

It is a problem in the field of high speed line printers to feed, fold and stack the printed fan folded continuous feed print media that is output by the line printer. A typical high speed line printer makes use of continuous feed, fan folded paper as the print media. As this paper is printed by the high speed line printer and output therefrom, a stacker mechanism is required to fold and stack the printed paper for retrieval by the operator. There are numerous prior art automated stacker mechanisms that have been used on high speed line printers. These prior art automated stacker mechanisms typically require the use of active mechanical devices to precisely control the folding and stacking of the fan folded continuous feed printed paper that is output by the high speed line printer. In addition, the operator is required to manually feed, load and adjust the media for proper stacking when starting a printing job with these automated stacker mechanisms. Since these devices operate on each sheet of fan folded paper as it is output by the high speed line printer, a failure to properly position a single sheet of the paper disrupts the operation of the automated stacker mechanism for all subsequent sheets of paper. By using complex mechanical devices to accomplish the fan folding and stacking, the probability of such an error occurring is significantly increased.

Included in the prior art automated stacker mechanisms is U.S. Pat. No. 4,030,720 which illustrates the use of an oscillating chute device to produce a folded stack of printed paper. The feeding and folding motions imparted to the printed paper are synchronized under the control of stepper motors that drive the paper feeding and folding devices, respectively. The difficulty with such an oscillating chute mechanism is that the motion of the oscillating chute must be synchronized with the movement of the paper such the chute is moved from one position to another with every sheet of the fan folded paper that is output by the high speed line printer. If a loss of synchronization occurs, the oscillating chute mechanism will not function to fold the continuous feed fan folded paper.

Another type of automated stacker mechanism is disclosed in U.S. Pat. No. 4,460,350 where a set of air jets are used to perform the folding operation. In this apparatus, two sets of air jets are used, each set being positioned on one side of the paper feed path. These air jets are alternately activated as each successive sheet of printed paper is output by the high speed line printer. The jets impinge the paper at a discrete location on the top surface of the page as it emanates from the printer to thereby cause the stream of paper to fold naturally in a stacker bin at the paper seams. Again, the operation of this apparatus must be synchronized with the paper movement in order for the apparatus to function properly. A loss of synchronization between the movement of the paper of the operation of the air jets causes this apparatus to fail to properly fold the printed fan fold continuous feed paper.

Another form of automated paper stacking apparatus is illustrated in U.S. Pat. No. 4,172,592 which discloses a compensating element that is operable to elevate the central portion of the stack of printed paper. The compensating element elevates the central portion of the stack with respect to the folded edges thereof to reduce the formation of a depression in the central portion that results from the transversely folded edge portions. In addition, means are provided in this apparatus for varying the elevation height of the compensating element as a function of the stack height. The difficulty with this support apparatus is that the operator is required to manually feed a number of sheets of the paper into the paper stacker in order for this device to function. In addition, this apparatus operates in conjunction with a pair of flapper arms in order to accomplish the paper folding operation.

A final category of paper stacker devices is the use of passive guides or slots. The difficulty with this apparatus is that they typically do not incorporate any positive sheet alignment mechanism to insure the proper positioning of the printed paper. Typically, these devices require that the operator manually feed a number of sheets of the fan folded continuous feed paper into the output bin and manually align these initial sheets to insure the proper operation of these guide slots.

Thus, there presently are no simple and reliable automated paper stacking devices that are operable to precisely fold and stack continuous feed fan folded printed paper without requiring operator intervention to feed, load and adjust the media at the start of a printing job.

SOLUTION

The above described problems are solved and a technical advance achieved in the field by the automated print media stacking apparatus which makes use of a passive guide in the bottom of the stacking bin to automatically initiate the folding operation on printed continuous feed fan fold print media (e.g. - paper) and to precisely fold and stack the printed media as it is output by the high speed line printer. The automated print media stack apparatus includes a forms refold tray that is located at the bottom of the stacking bin. The refold tray includes a slot located in the center thereof for automatically receiving the leading edge of the firs sheet of print media that is output by the high speed line printer. An associated media puller is used to insure the proper positioning of the leading edge of the first sheet of print media into the slot in the paper refold tray.

In operation, the media puller receives the first sheet of print media output by the high speed line printer. Sensors located in the media puller detect the arrival of the leading edge of the first sheet of printed media from the high speed line printer and function to activate the media puller to translate in a downward direction to place the media puller in juxtaposed position to the refold tray. Once the media puller is so positioned, a control circuit slowly feeds a predetermined length of the print media out of the media puller such that the leading edge of this print media is inserted into the slot in the center of the refold tray. Once the print media is seated in the slot in the refold tray, the media puller moves in a vertical direction away from the refold tray a sufficient distance to allow the printed sheets of continuous feed fan fold print media to be output therefrom and fold into a neat stack on the refold tray. A pair of fixed forms guides and two pairs of flexible forms dampers are also used to guide the sheets of printed media into position under a pair of paddlewheels which compact the folded printed media in the stack on the refold tray. The use of the slot for the refold tray causes the sheets of printed media to automatically fold by themselves without the intervention of any mechanical device as was used in the prior art.

Thus, the present automated print media stacker apparatus functions without operator intervention to automatically initialize the loading of the leading edge of the print media into the print media stacking and folding mechanism. This apparatus then operates to automatically fold and stack the continuous feed fan folded print media that is output by the high speed line printer without the use of any complex mechanical devices or air jets.

DETAILED DESCRIPTION

The automated print media stacking apparatus makes use of a passive guide in the bottom of the stacking bin to automatically initiate the folding operation on printed continuous feed fan fold print media (e.g. - paper) and to precisely refold the printed media as it is output by the high speed line printer. The automated print media stack apparatus includes a forms refold tray that is located at the bottom of the stacking bin. The refold tray includes a slot located in the center thereof for automatically receiving the leading edge of the first sheet of print media that is output by the high speed line printer. An associated media puller is used to insure the proper positioning of the leading edge of the first sheet of print media into the slot in the paper refold tray. A pair of fixed forms guides and two pairs of flexible forms dampers are also used to guide the sheets of printed media into position under a pair of paddlewheels which compact the folded printed media in the stack on the refold tray.

Figure 1:
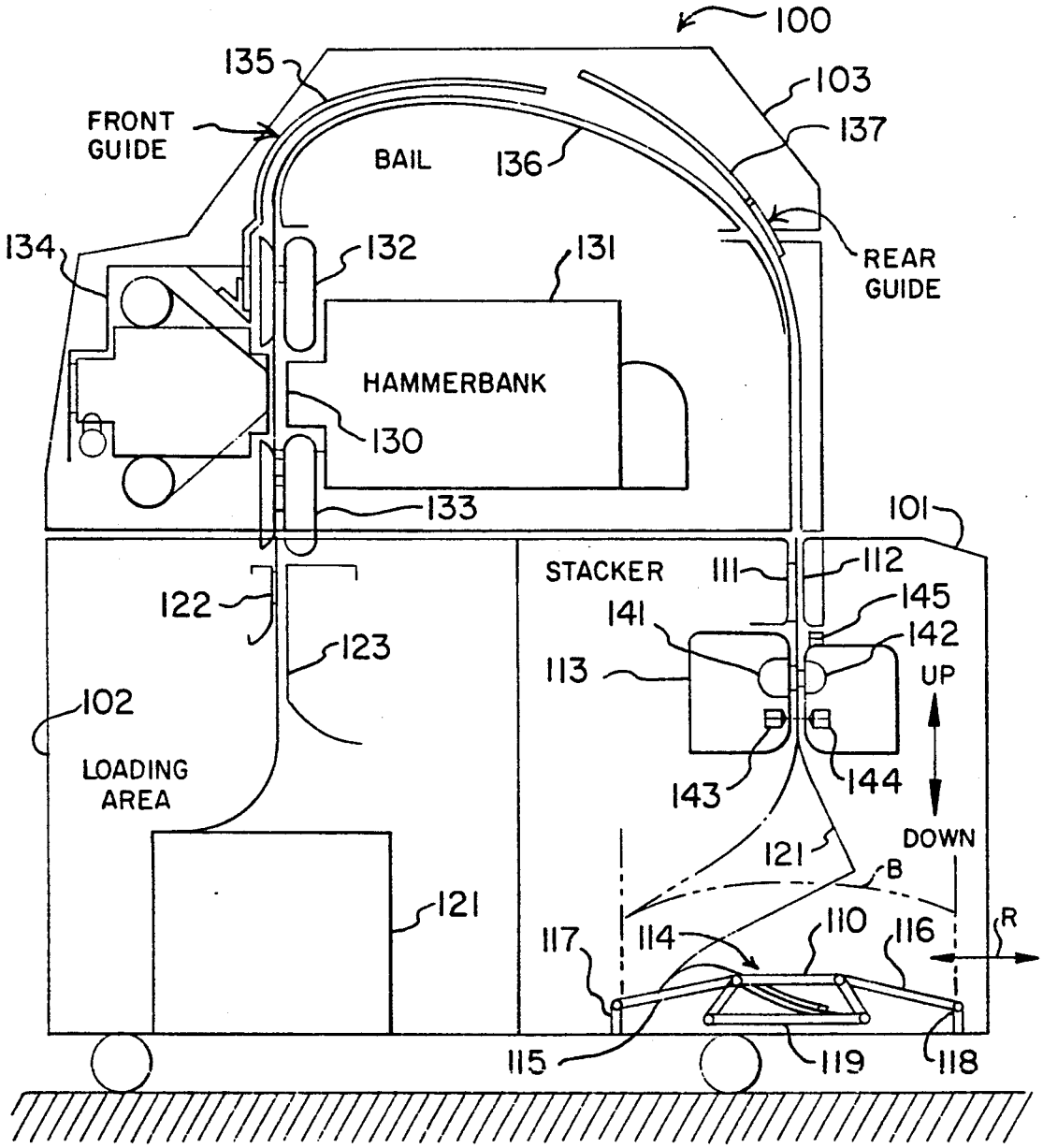
FIG. 1 illustrates the general architecture of the automated print media stacker apparatus and the associated line printer.

The general architecture of the automated print media stacker apparatus and the associated line printer is illustrated in FIG. 1. Printer 100 includes a media loading area 102 that provides the continuous feed fan folded print media to the print mechanism 103 which functions to apply printing to the print media and output the print media to stacker 101 where the print media is refolded and stacked for retrieval by an operator. Media loading area 102 consists of a stack of the continuous feed fan fold print media 121 which is fed through media guides 122, 123 to the print mechanism 103. The media guides 122, 123 function to properly align the print media 121 for presentation to the print mechanism 103. The print mechanism 103 includes two sets of tractor mechanisms 132, 133 which function to positively transport the print media 121 in controlled fashion across hammerbank 131 and ribbon mechanism 134. Front guide 135, bail 136 and rear guide 137 provide a paper feed path for the print media 121 that is output once hammerbank 131 and ribbon mechanism 134 apply printing thereto. The operation of the above described apparatus is well known in the art and will not be described in any further detail herein. Suffice it to say that front guide 135, bail 136 and rear guide 137 function to properly orient and present the print media 121 that is output by print mechanism 103 to stacker 101.

Figure 3:
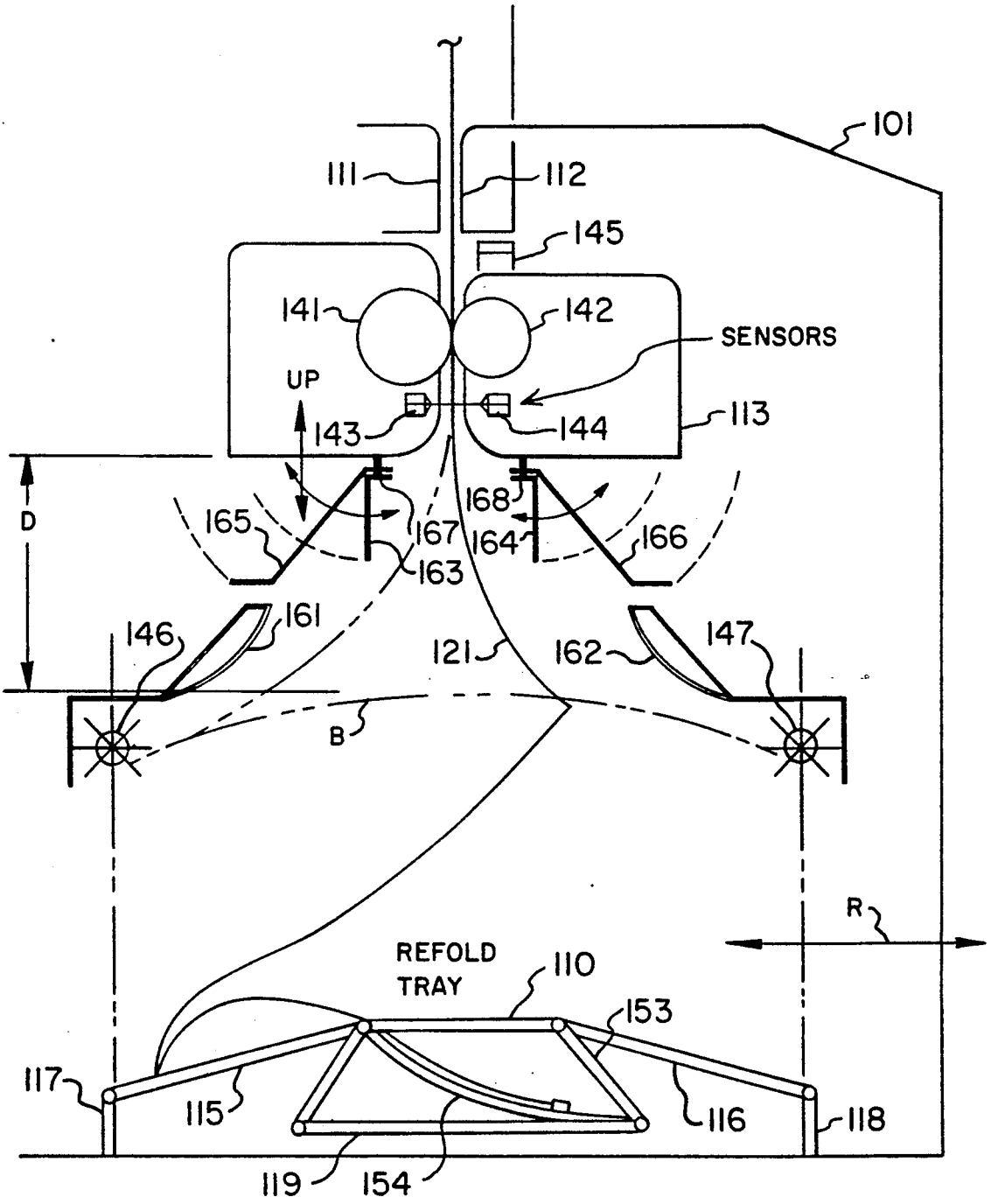
FIG. 3 illustrates the positioning of the media puller with respect to the refold tray for stacking the print media.

Stacker 101 includes stacker guides 111, 112 to properly orient the print media 121 as it is received from the print mechanism 103. Stacker guides 111, 112 feed the print media 121 into a media puller 113 which functions to pull the print media 121 through front guide 135, bail 136 and rear guide 137 of print mechanism 103 to prevent the print media 121 from bunching up in the guides. The print media 121 is fed in controlled fashion by media puller 113 to refold tray 114 where the continuous feed fan folded paper is refolded. The forms dampers, forms guides and paddlewheels of the paper stack mechanism are not shown in FIG. 1 for simplicity and are illustrated in FIG. 3. Refold tray 114 can be horizontally moved in the direction indicated by arrow R in order for an operator to retrieve the stack of refolded printed media therefrom.

STACKER OPERATION

Figure 2:
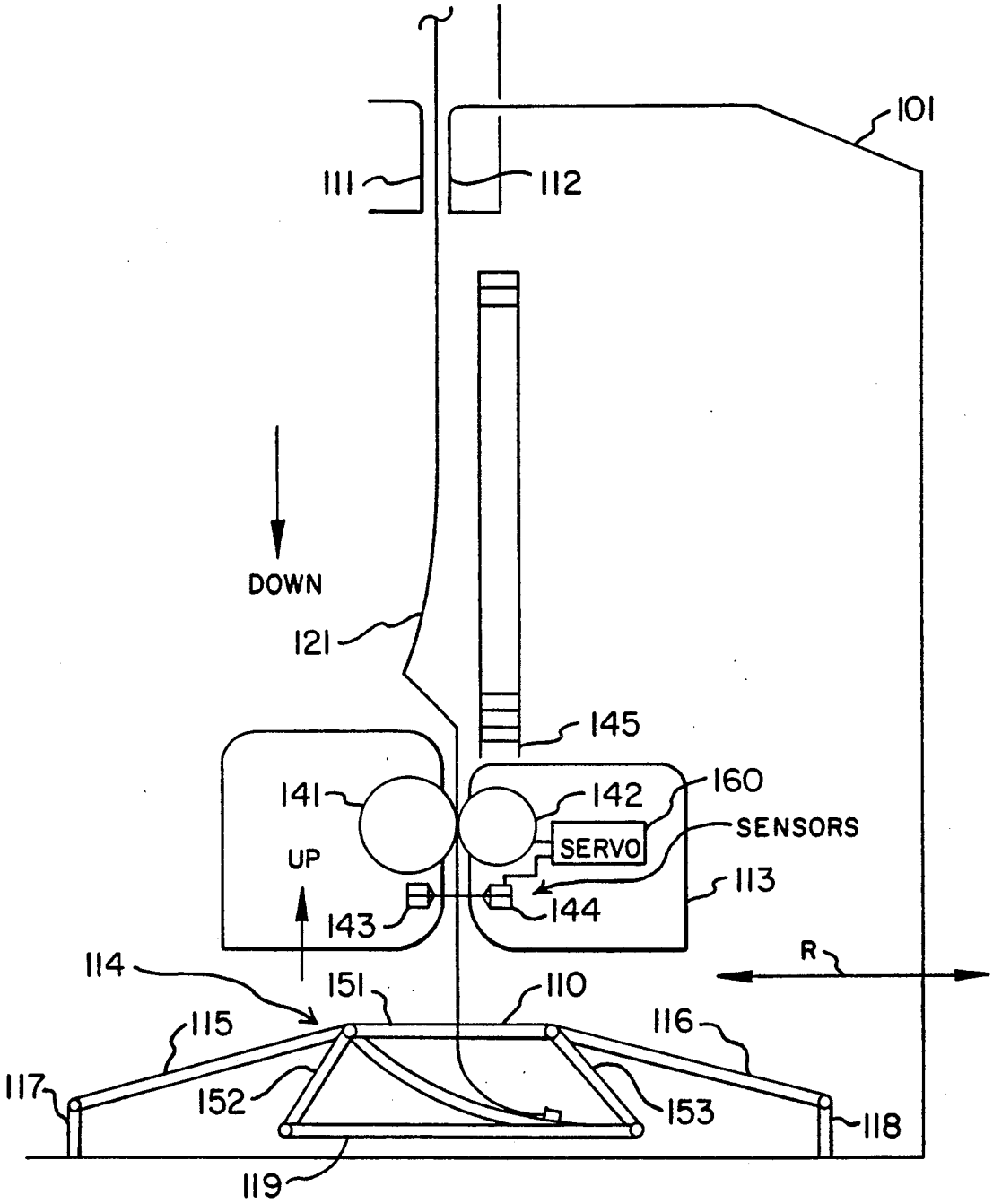
FIG. 2 illustrates the positioning of the media puller with respect to the refold tray for initializing the print media feed.

FIG. 2 illustrates the positioning of the media puller 113 with respect to the paper refold tray 114 for initializing print media 121 feed. In operation, the media puller 113 receives the first sheet of print media 121 output by the high speed line printer print mechanism 103. Media puller 113 includes a pair puller rollers 141, 142 which are operable to frictionally engage the print media 121 and pull the print media 121 into stacker 101 from print mechanism 103. Puller rollers 141, 142 are powered by a motor (not shown) that cause the two puller rollers 141, 142 to rotate at a constant speed, which speed is selectable so that the movement of the print media 121 through media puller 113 is in synchronization with the motion of the print media 121 through the print mechanism 103. Sensors 143, 144 located on the media puller 113 detect the arrival of the leading edge of the first sheet of print media 121 from the high speed line printer print mechanism 103 and function to activate the media puller 113 to translate in a downward direction to place the media puller 113 in juxtaposed position to the slot 110 in refold tray 114. Media puller 113 translates its position in a downward direction by the use of a elevator mechanism 145 that enables media puller 113 to translate either up or down in a vertical direction under the control of a servo mechanism 160. Once the media puller 113 is so positioned, servo mechanism 160 slowly feeds a predetermined length of the print media 121 out of the media puller 113 such that the leading edge of this print media 121 is automatically inserted into the slot 110 in the center of the refold tray 114.

As shown in FIG. 3, once the print media 121 is seated in the slot 110 in the refold tray 114 against paper stop 155, servo mechanism 160 moves the media puller 113 in a vertical direction away from the refold tray 114 a sufficient distance D, as illustrated in FIG. 3, to allow the printed sheets of continuous feed fan fold print media 121 to be output therefrom and fold into a neat stack on the refold tray 114 across slot 110. The use of the slot 110 in the refold tray 114 causes the sheets of print media 121 to automatically fold and stack by themselves without the intervention of any mechanical device as was used in the prior art.

In order to accurately guide the movement of print media 121 onto the stack, a pair of fixed form guides 161, 162 are provided. The form guides 161, 162 consist of a loop-shaped element positioned above paddlewheels 146, 147 and forming an inverted funnel to guide the fold edges of print media 121 to paddlewheels 146, 147. The paddlewheels 146, 147 are attached to a frame (not shown) connected to media puller 113 such that a fixed distance is maintained therebetween. The paddlewheels 146, 147 are motor or belt driven and function to compact the print media 121 into a tight stack as illustrated by dashed line "B". In addition, two pairs of flexible forms dampers 163/164, 165/166 manufactured from Mylar or Kapton are attached via bolts 167, 168, respectively to media puller 113. These flexible forms dampers 163–166 are pivotally attached to media puller 113 and are movable in the direction indicated by the curved arrows. The forms dampers 163–166 operate cooperatively with forms guides 161, 162 to form a chute, in the form of an inverted funnel, to guide the print media to paddlewheels 146, 147.

PAPER REFOLD TRAY

Figure 4:
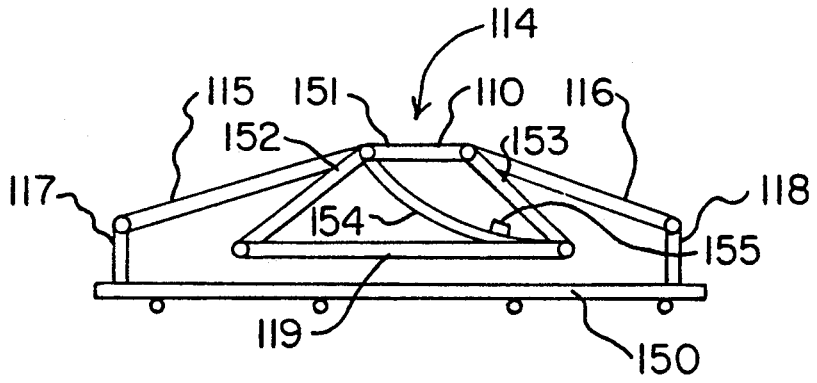
FIG. 4 illustrates a side view of one embodiment of the print media refold tray.
Figure 5:
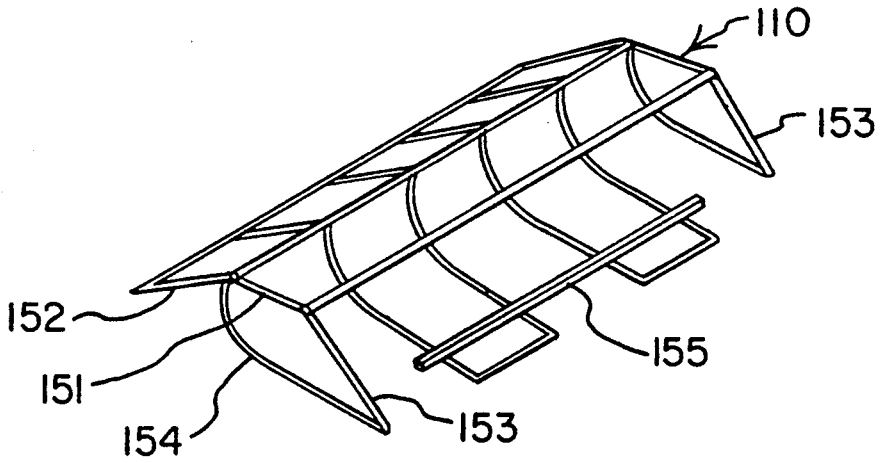
FIG. 5 illustrates a perspective view of one embodiment of the print media refold tray.

FIGS. 4 and 5 illustrate the refold tray 114 which includes a pair of paper support arms 115, 116 which are attached to a base 119. Supports 117, 118 are provided for paper support arms 115, 116 respectively to support the distal ends thereof to maintain paper support arms 115, 116 in the position illustrated in FIGS. 1 and 2 in spite of the weight of the print media 121 that is refolded on arms 115, 116 as shown in FIG. 3. Base 119 includes a carriage mechanism 150 such that an operator can pull base 119 of the refold tray 114 and the refold print media 121 stacked thereon out from stacker 101 for easy retrieval therefrom. Refold tray 114 includes a rectangular shaped slot frame 151 which is connected to base 119 by support arms 152, 153 located at each end of slot frame 151. A plurality of support arms 152, 153 extend upward in a vertical direction from the base 119 to support slot frame 151 a predetermined distance above base 119. Curved arms 154 extend from the junction of slot frame 151 and support arm 152 to the junction of base 119 and support arm 153. Curved arms 154 provide a guide, in cooperation with slot frame 151, to guide the leading edge of print media 121 to paper stop 155. Paper stop 155 is adjustable to compensate for various lengths of paper that can be input to refold tray 114. When the leading edge of the print media 121 comes to rest against paper stop 155, the perforations in the continuous feed fan folded print media 121 cause the print media 121 to automatically fold as is shown in FIG. 3. The shape of refold tray 114 causes print media 121 to automatically fold and stack as shown by the broken line labeled B on FIG. 3.

In addition, compactors 146, 147 are provided to provide a more controlled folding and stacking operation. Compactors 146, 147 consist of a pair of paddle wheels that function to compact the form folds at the perforations in the continuous feed fan folded print media 121 to flatten out any wrinkles, bulges or entrapped air in the stacked print media 121 to form a minimum height stack. The compactors 146, 147 are powered by a motor (not shown) and translate vertically in an upward direction with the puller 113 to maintain their position at the top of the stack of folded continuous feed fan folded print media 121.

While a specific embodiment of this invention has been disclosed, it is expected that those skilled in the art can and will design alternate embodiments of this invention that fall within the scope of the appended claims.

We claim:

1. Apparatus for automatically stacking a previously fan folded continuous feed print media (121) that is output at a predetermined speed from a printer (100) comprising:

a tray (150) located below said printer output (103);

a substantially rectangular shaped slot (110) having first and second sides located opposite each other for receiving between said first and second sides a leading edge of said fan folded continuous feed print media (121) as it is fed out of said printer output (103);

support means (115–118) connected to said slot (110) and said tray (150) for supporting said slot (110) a predetermined distance above said tray (150); and stop means (155), located between said slot (110) and said tray (150), for accepting a predetermined length of said fan folded continuous feed print media (121) as said leading edge is fed into said slot (110) to automatically cause said continuous feed print media (121) to automatically fold across said slot (110) as it feeds from said printer output (103);

print media feed means (113), located above said slot (110) and responsive to said print media feed means (113) being positioned juxtaposed to said slot (110), for automatically controllably feeding said leading edge of said continuous feed print media (121) in a downward direction into said slot (110) at a speed less than said predetermined speed;

means (145), responsive to said leading edge of said continuous feed print media (121) seating against said stop means (155) in said slot (110), for translating said print media feed means (113) in said vertical direction a predetermined distance (D) above said slot (110);

wherein said translating means (145) is responsive to said fan folded continuous feed print media (121) folding across said slot (110) for maintaining said predetermined distance (D) between said print media feed means (113) and the top of said continuous feed print media (121) folded across said slot (110) as said continuous feed print media (121) is output from said print media feed means (113) at said predetermined speed.

2. The apparatus of claim 1 further including:

print media edge guide means (154) located below said slot (110) for automatically guiding said leading edge of said continuous feed print media (121) in a downward direction to said stop means (155).

3. The apparatus of claim 1 wherein said print media feed means (113) includes:

print media guide means (161–168) in the shape of an inverted funnel and positioned above said slot (110) for guiding said continuous feed print media (121) in said downward direction.

4. The apparatus of claim 1 wherein said support means (115–118) includes:

first (115, 117) and second (116, 118) support arms each having a first end connected to said first and second sides of said slot (110), respectively and a second end extending in said downward direction and connected to said tray (150) equidistant from said slot (110) for supporting the folded ends of said folded print media (121).

5. Apparatus for automatically stacking a previously fan folded continuous feed print media (121) output by a printer (100) at a predetermined speed comprising:

a bin (101) having a bottom (150);

a substantially rectangular shaped slot (110) having first and second sides located opposite each other;

first support arm (115, 117) having a top and a bottom thereof;

second support arm (116, 118) having a top and a bottom thereof;

said top of said first (115, 117) and second (116, 118) arms extending from said bottom (150) of said bin and joined to said first and second side of said slot (110), respectively for supporting said slot (110) a predetermined distance above said bottom (150) of said bin which slot (110) functions to receive a leading edge of said continuous feed print media (121) as it is fed out of said printer output (103);

stop means (155) located between said bottom (150) of said bin and said slot (110) for accepting a predetermined length of said continuous feed print media (121) as said leading edge is fed into said slot (110) to automatically cause said continuous feed print media (121) to automatically fold across said slot (110) as it feeds from said printer (100);

print media feed means (113) located above said slot (110) and responsive to said print media feed means (113) being positioned juxtaposed to said slot (110), for controllably feeding said leading edge of said continuous feed print media (121) in a downward direction into said slot (110) at a speed less than said predetermined speed;

means (145), responsive to said leading edge of said continuous feed print media (121) seating against said stop means (155) in said slot (110), for translating said print media feed means (113), in a direction opposite said downward direction a predetermined distance (D) above said slot (110);

wherein said translating means (145) is responsive to said continuous fed print media (121) refolding on said slot (110) for maintaining said predetermined distance (D) between said print media feed means (113) and the top of said continuous feed print media (121) refolded on said slot (110) as said continuous feed print media (121) is output from said print media feed means (113) at said predetermined speed.

6. The apparatus of claim 5 further including:

print media edge guide means (154) located below said slot (110) for automatically guiding said leading edge of said continuous feed print media (121) in a downward direction to said stop means (155).

7. The apparatus of claim 5 wherein said print media feed means (113) includes:

print media guide means (161–168) in the shape of an inverted funnel and positioned above said slot (110) for guiding said continuous feed print media (121) in said downward direction.

* * * * *